US006670930B2

(12) United States Patent
Navarro

(10) Patent No.: US 6,670,930 B2
(45) Date of Patent: Dec. 30, 2003

(54) ANTENNA-INTEGRATED PRINTED WIRING BOARD ASSEMBLY FOR A PHASED ARRAY ANTENNA SYSTEM

(75) Inventor: Julio A. Navarro, Kent, WA (US)

(73) Assignee: The Boeing Company, Chicago, IL (US)

( * ) Notice: Subject to any disclaimer, the term of this patent is extended or adjusted under 35 U.S.C. 154(b) by 8 days.

(21) Appl. No.: 10/007,067

(22) Filed: Dec. 5, 2001

(65) Prior Publication Data

US 2003/0103012 A1 Jun. 5, 2003

(51) Int. Cl.[7] ..... H01Q 13/00

(52) U.S. Cl. ..... 343/776; 343/700 MS; 343/853

(58) Field of Search ..... 343/700 MS, 776, 343/777, 778, 824, 771, 853, 772

(56) References Cited

U.S. PATENT DOCUMENTS

| | | | | |
|---|---|---|---|---|
| 5,008,678 A | | 4/1991 | Herman | 342/158 |
| 5,136,304 A | | 8/1992 | Peters | 343/777 |
| 5,276,455 A | | 1/1994 | Fitzsimmons et al. | 343/777 |
| 5,825,333 A | | 10/1998 | Kudoh et al. | 343/781 R |
| 5,886,671 A | | 3/1999 | Riemer et al. | 343/776 |
| 6,018,659 A | | 1/2000 | Ayyagari et al. | 455/431 |
| 6,166,705 A | * | 12/2000 | Mast et al. | 343/853 |
| 6,297,775 B1 | * | 10/2001 | Haws et al. | 343/700 MS |
| 6,320,547 B1 | * | 11/2001 | Fathy et al. | 343/700 MS |
| 6,429,816 B1 | | 8/2002 | Whybrew et al. | 343/700 MS |

FOREIGN PATENT DOCUMENTS

| | | |
|---|---|---|
| EP | 1 094 541 A2 | 4/2001 |
| WO | WO 00/39893 | 7/2000 |

OTHER PUBLICATIONS

Publication from Microwave Journal, Jan. 1994, entitled "A connectorless module for an EHF phased–array antenna".

H. Wong et al.; An EHF Backplate Design for Airborne Active Phased Array Antennas; Hughes Aircraft Company; El Segundo, CA; pp. 1253 & 1256; 1991 IEEE.

* cited by examiner

*Primary Examiner*—Don Wong
*Assistant Examiner*—Shih-Chao Chen
(74) *Attorney, Agent, or Firm*—Harness, Dickey & Pierce P.L.C.

(57) ABSTRACT

A phased array antenna system formed from an antenna-integrated printed wiring board for performing the functions of a waveguide impedance matching layer, a honeycomb support structure, RF antenna probes, DC logic and RF distribution. The printed wiring board construction of the present invention significantly reduces the number of component parts required to form a phased array antenna assembly, as well as simplifying the manufacturing process of the antenna assembly. The antenna-integrated printed wiring board is formed from an inexpensive, photolithographic process to create a single part (or optionally a two part) structure for performing the above-listed functions.

12 Claims, 4 Drawing Sheets

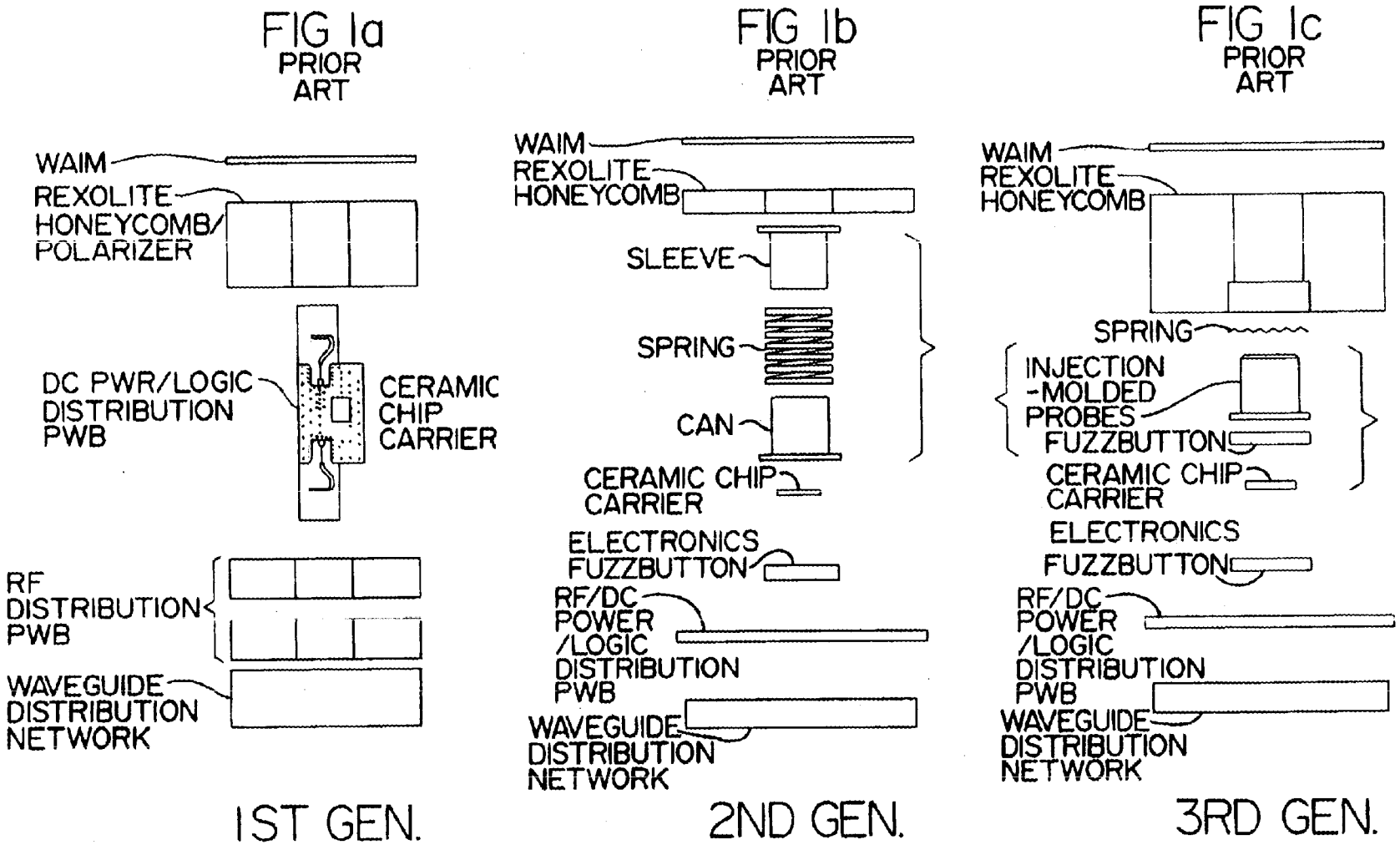
FIG 1c
PRIOR ART
WAIM
REXOLITE HONEYCOMB
SPRING
INJECTION -MOLDED PROBES
FUZZBUTTON
CERAMIC CHIP CARRIER
ELECTRONICS
FUZZBUTTON
RF/DC POWER /LOGIC DISTRIBUTION PWB
WAVEGUIDE DISTRIBUTION NETWORK
3RD GEN.
FIG 1b
PRIOR ART
WAIM
REXOLITE HONEYCOMB
SLEEVE
SPRING
CAN
CERAMIC CHIP CARRIER
ELECTRONICS
FUZZBUTTON
RF/DC POWER /LOGIC DISTRIBUTION PWB
WAVEGUIDE DISTRIBUTION NETWORK
2ND GEN.
FIG 1a
PRIOR ART
WAIM
REXOLITE HONEYCOMB POLARIZER
CERAMIC CHIP CARRIER
DC PWR/LOGIC DISTRIBUTION PWB
RF DISTRIBUTION PWB
WAVEGUIDE DISTRIBUTION NETWORK
1ST GEN.

20
10
14
4
4
12
16
18
3
3

14a
14b 28
28
14a 22b
5
22a
6
6
12a 12b
12c
24
18
24

ANTENNA-INTEGRATED PRINTED WIRING BOARD ASSEMBLY FOR A PHASED ARRAY ANTENNA SYSTEM

FIELD OF THE INVENTION

The present invention relates to phased array antennas, and more particularly to an integrated printed wiring board antenna for forming a phased array antenna system in which the antenna elements and their associated electronics are integrated onto one, or a pair of, printed wiring board assemblies.

BACKGROUND OF THE INVENTION

The assignee of the present application, The Boeing Company, is a leading innovator in the design of high performance, low cost, compact phased array antenna modules. The Boeing antenna module shown in FIGS. 1*a*–1*c* have been used in many military and commercial phased array antennas from X-band to Q-band. These modules are described in U.S. Pat. No. 5,886,671 to Riemer et al and U.S. Pat. No. 5,276,455 to Fitzsimmons et al, both being hereby incorporated by reference.

The in-line first generation module was used in a brick-style phased-array architecture at K-band and Q-band frequencies. This approach is shown in FIG. 1*a*. This approach requires some complexity for DC power, logic and RF distribution but it provides ample room for electronics. As Boeing phased array antenna module technology has matured, many efforts made in the development of module technology resulted in reduced parts count, reduced complexity and reduced cost of several key components of such modules. Boeing has also enhanced the performance of the phased array antenna with multiple beams, wider instantaneous bandwidths and greater polarization flexibility.

The second generation module, shown in FIG. 1*b,* represented a significant improvement over the in-line module of FIG. 1*a* in terms of performance, complexity and cost. It is sometimes referred to as the "can and spring" design. This design can provide dual orthogonal polarization in an even more compact, lower-profile package than the in-line module of FIG. 1*a*. The can-and-spring module forms the basis for several dual simultaneous beam phased arrays used in tile-type antenna architectures from X-band to K-band. The can and spring module was later improved even further through the use of chemical etching, metal forming and injection molding technology. The third generation module developed by the assignee, shown in FIG. 1*c,* provides an even lower-cost production design adapted for use in a dual polarization receive phased array antenna.

Each of the phased-array antenna module architectures shown in FIGS. 1*a*–1*c* require multiple module components and interconnects. In each module, a relatively large plurality of vertical interconnects such as buttons and springs are used to provide DC and RF connectivity between the distribution printed wiring board (PWB), ceramic chip carrier and antenna probes.

A further step directed to reduce the parts count and assembly complexity of the antenna module as described above is described in pending U.S. patent application Ser. No. 09/915,836, "Antenna Integrated Ceramic Chip Carrier For A Phased Array Antenna". This application involves forming an antenna integrated ceramic chip carrier (AICC) module which combines the antenna probe (or probes) of the phased array module with the ceramic chip carrier that contains the module electronics into a single integrated ceramic component. The AICC module eliminates vertical interconnects between the ceramic chip carrier and antenna probes and takes advantage of the fine line accuracy and repeatability of multi-layer, co-fired ceramic technology. This metallization accuracy, multi-layer registration produces a more repeatable, stable design over process variations. The use of mature ceramic technology also provides enhanced flexibility, layout and signal routing through the availability of stacked, blind and buried vias between internal layers, with no fundamental limit to the layer count in the ceramic stack-up of the module. The resulting AICC module has fewer independent components for assembly, improved dimensional precision and increased reliability.

In spite of the foregoing improvements in antenna module design, there is still a need to further combine more functions of a phased array antenna into a single component. This would further reduce the parts count, improve alignment and mechanical tolerances during manufacturing and assembly, improve electrical performance, and reduce assembly time and processes to ultimately reduce phased array antenna system costs. More specifically, it would be highly desirable to eliminate dielectric "pucks" that need to be used in a completed antenna module, as well as to entirely eliminate the use of buttons, button holders, flex members, cans, sleeves, elastomers and springs. If all of these independent parts could be eliminated, then the only issue bearing on the cost of the antenna assembly would be the material and process cost of manufacturing the antenna assembly.

SUMMARY OF THE INVENTION

The present invention is directed to a phased array antenna system which incorporates an antenna integrated printed wiring board (AIPWB) assembly. The AIPWB includes circuitry for DC/logic and RF power distribution as well as the antenna probes. The metal honeycomb waveguide plate used with previous designs of phased array antenna modules is eliminated in favor of a multi-layer printed wiring board which includes vias which form circular waveguides and a plurality of layers (stack-up) for providing a honeycomb waveguide structure and wide angle impedance matching network (WAIM). Thus, the antenna system of the present invention completely eliminates the need for dielectric pucks, which previous designs of phased array antenna modules have heretofore required. The entire phased array antenna system is thus formed from either a single, multi-layer printed wiring board, or two multi-layer printed wiring boards placed adjacent to one another. This construction significantly reduces the independent number of component parts required to produce a phased array antenna system. Each of the two printed wiring boards are produced using an inexpensive, photolithographic process. Forming the entire antenna system essentially into one or two printed wiring boards significantly eases the assembly of the phased array antenna system, as well as significantly reducing its manufacturing cost.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIGS. 1*a*–1*c* represent prior art module designs of the assignee of the present invention;

DETAILED DESCRIPTION OF THE PREFERRED EMBODIMENTS

The following description of the preferred embodiment(s) is merely exemplary in nature and is in no way intended to limit the invention, its application, or uses.

Figure 2:
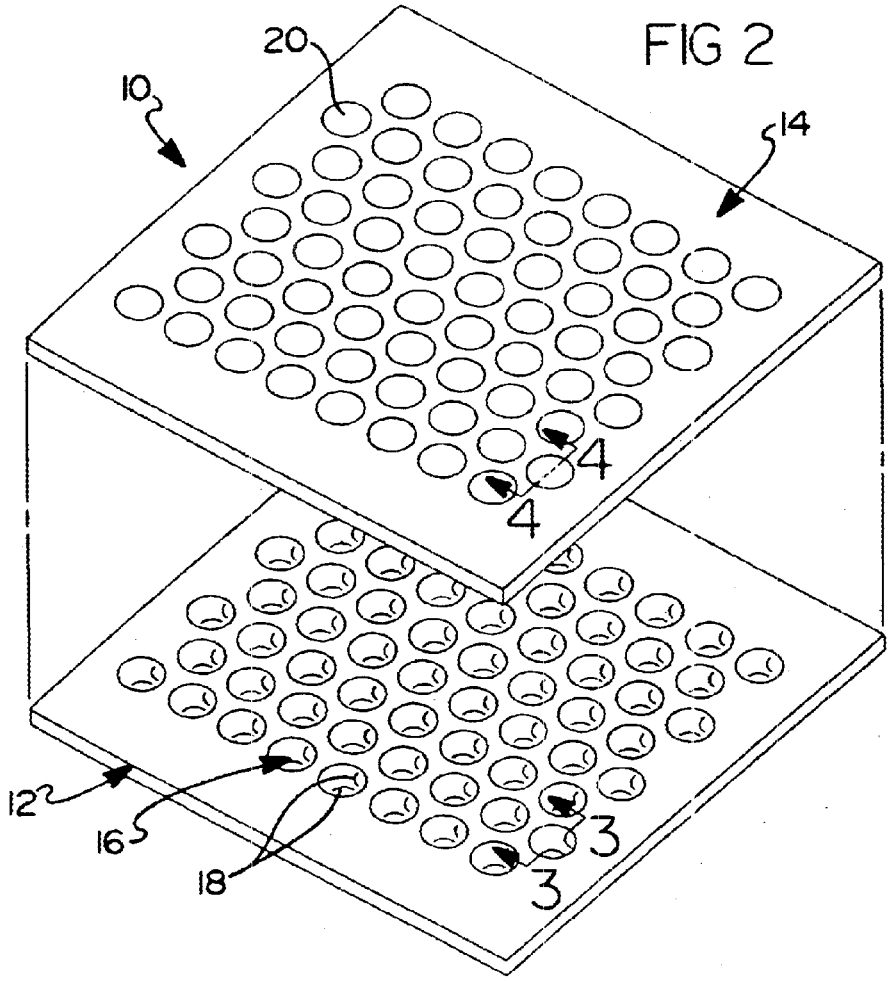
FIG. 2 is an exploded perspective view of the two major components forming a 64 element phased array antenna system in accordance with a preferred embodiment of the present invention.

Referring to FIG. 2, there is illustrated a pre-assembled view of a 64 element phased array antenna system 10 in accordance with a preferred embodiment of the present invention. It will be appreciated immediately, however, that the present invention is not limited to a 64 element phased array antenna system, but that the principles and teachings set forth herein could be used to produce phased array antenna systems having a greater or lesser plurality of antenna elements. The phased array antenna system 10 incorporates a multi-layer probe-integrated printed wiring board 12 and a multi-layer waveguide printed wiring board 14 which are adapted to be disposed adjacent one another in abutting relationship when fully assembled. Conventional threaded or non-threaded fasteners (not shown) can be used to secure the two wiring boards 12 and 14 in close, secure abutting contact. The probe-integrated printed wiring board 12 includes a plurality of antenna elements or modules 16 arranged in an 8×8 grid. Each antenna element 16 includes a pair of radio frequency (RF) probes 18, but it will be appreciated again that merely a single probe could be incorporated, if desired, and that greater than two probes could be included just as well to meet the needs of a specific application.

The waveguide printed wiring board 14 includes a plurality of circular waveguides 20 formed to overlay each of the antenna elements 16. It will be appreciated that as the operating frequency of the antenna system 10 increases, the thickness of the wiring board 14 will decrease. Conversely, as the operating frequency decreases, the thickness of the board 14 will increase.

Figure 3:
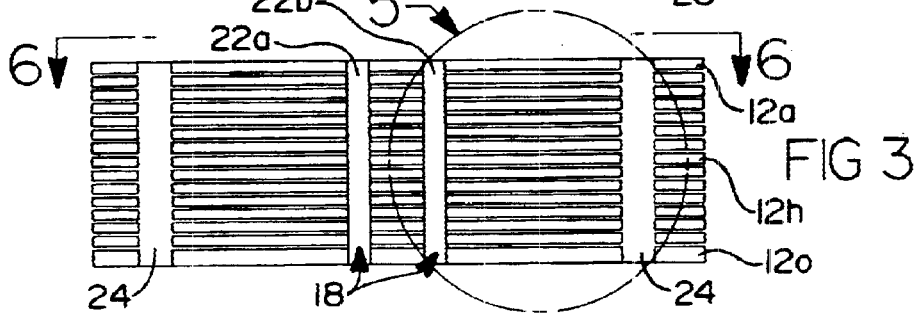
FIG. 3 is a cross sectional side view through one antenna site taken in accordance with section line 3—3 in FIG. 2.

Referring to FIG. 3, the probe-integrated printed wiring board 12 can be seen to include a plurality of 15 independent layers 12*a*–12*o* sandwiched together. Again, it will be appreciated that a greater or lesser plurality of layers could be provided to meet the needs of a specific application. RF vias 22*a* and 22*b* are used to form the probes 18 while vias 24 are arranged circumferentially around the vias 22*a* and 22*b* to effectively form a cage-like conductive structure 26, also known as a "can" for the antenna element 16. This is illustrated in greater detail in FIG. 6. It will be appreciated that the illustration of 20 vias to form the can 26 is presented for illustrative purposes only, and that a greater or lesser plurality of vias 24 could be employed.

Figure 4:
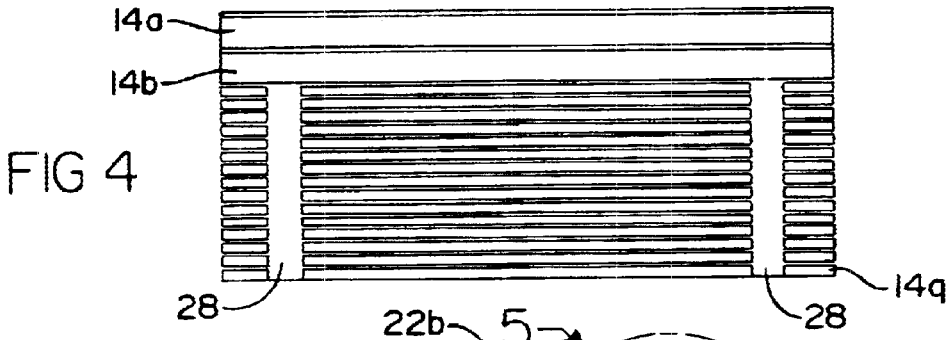
FIG. 4 is a cross sectional side view taken in accordance with section line 4—4 through the upper printed wiring board shown in FIG. 2 illustrating the vias used for forming a circular waveguide, honeycomb support structure, and the stack-up for the wide angle impedance matching network (WAIM)
Figure 6:
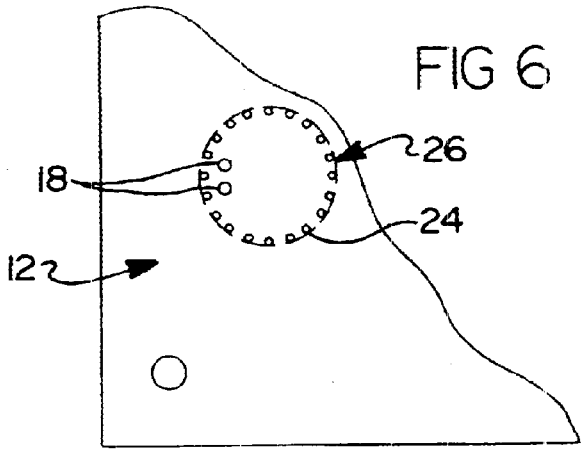
FIG. 6 is a plan view of a portion of the probe-integrated wiring board showing the vias that form the can for each pair of RF radiating elements.

Referring now to FIG. 4, the waveguide printed wiring board can be seen to also include a plurality of independent layers 14*a*–14*q* which form a wide angle impedance matching network (WAIM). Vias 28 extending through layers 14*c*–14*q*, form the waveguide portion of the wiring board 14. Again, it will be appreciated that vias 28 are arranged in circular orientations such as shown in FIG. 6. Layers 14*a* and 14*b* form impedance matching layers.

Each of the printed wiring boards 12 and 14 are formed through an inexpensive, photolithographic process such that each wiring board 12 and 14 is formed as a multi-layer part. The probe-integrated printed wiring board 12 includes the antenna probes 18 and DC/logic and RF distribution circuitry. On this component, the discrete electronic components (i.e., MMICs, ASICs, capacitors, resistors, etc) can be placed and enclosed by a suitable lid or cover (not shown). Accordingly, the multiple electrical and mechanical functions of radiation, RF distribution, DC power and logic are all taken care of by the probe-integrated printed wiring board 12.

Figure 5:
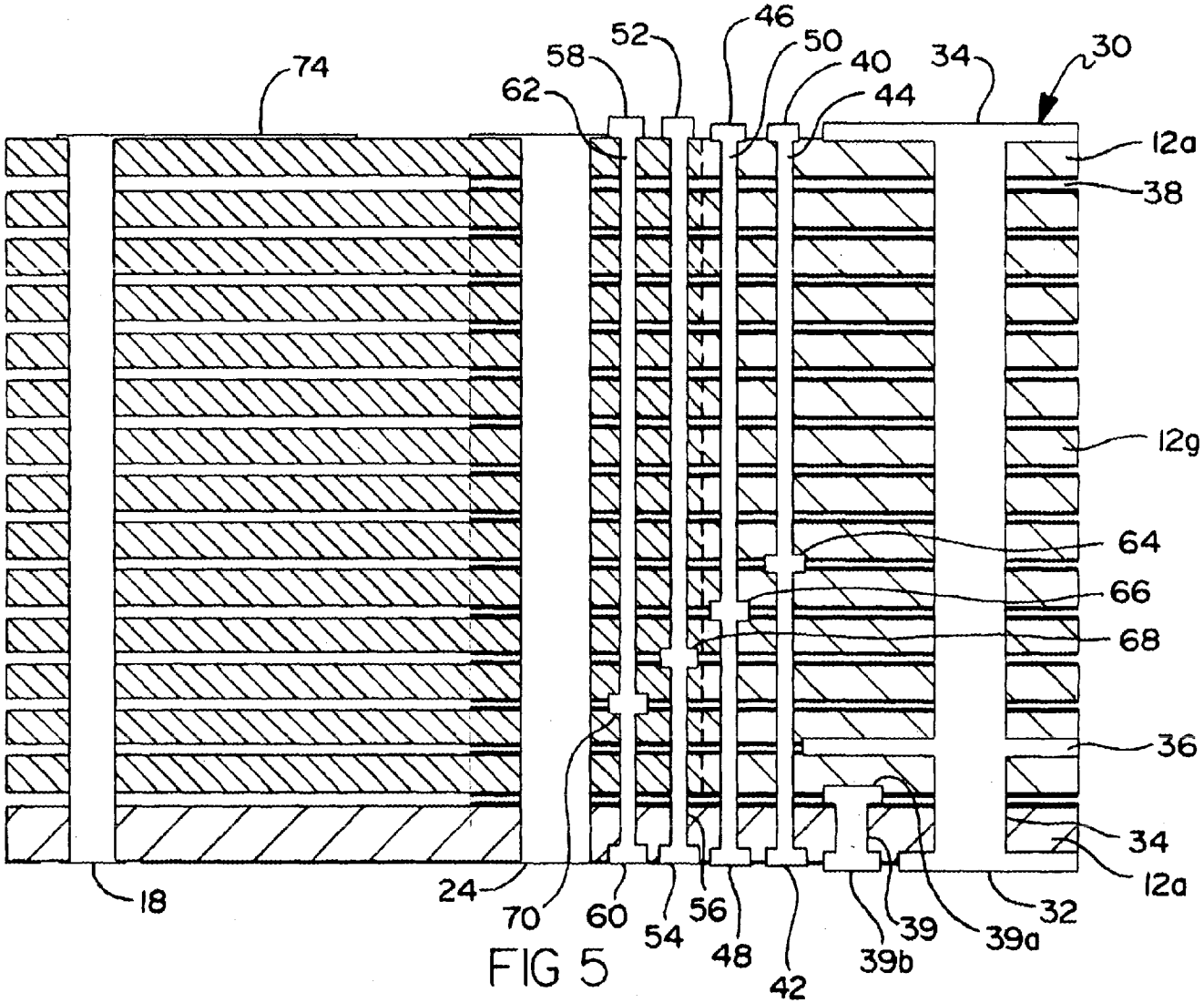
FIG. 5 is a detailed, side cross sectional view of portion 5 of the probe-integrated printing wiring board of FIG. 3 illustrating in greater detail the electrical interconnections formed within the layers of this printed wiring board assembly.

Referring now to FIG. 5, the probe-integrated printed wiring board 12 is shown in further detail. Layer 12*a* comprises a ground pad 30 on an outer surface thereof. Ground pad 30 is electrically coupled to a ground pad 32 on an outer surface of layer 12*o* by a conductive via 34 extending through each of the layers 12*a*–12*o*. Via 34 is also electrically coupled to an RF ground circuit trace 36. Layers 12*a*–12*i* are separated by ground layers 38. The ground layers help to reduce the inductance of the vias formed in the board 12.

With further reference to FIG. 5, via 39 and pads 39*a* and 39*b* provide electrical coupling to layer 12*o*, which forms a stripline for distributing RF energy between the RF probes 18 and the vias 39. It will be appreciated that for a 64 element phased array antenna, there will be 64 of the vias 39, with each via 39 associated with one of the 64 antenna elements.

Referring further to FIG. 5, pad 40 on layer 12*a* and pad 42 on layer 12*o* are electrically coupled by a conductive via 44. Pad 46 on layer 12*a* and pad 48 on layer 12*o* are electrically coupled by conductive via 50. Pad 52 on layer 12*a* and pad 54 on layer 12*o* are electrically coupled by conductive via 56, while pad 58 on layer 12*a* and pad 60 on layer 12*o* are electrically coupled by conductive via 62. Via 44 extends completely through all of the layers 12*a*–12*o* and is also electrically coupled to a clock circuit trace 64. Via 50 extends through all of the layers 12*a*–12*o* and is electrically coupled to a data circuit trace 66, Via 56 extends through all of layers 12*a*–12*o* and is electrically coupled to a DC source (−5V) circuit trace 68. Via 62 likewise extends through all of layers 12*a*–12*o* and is electrically coupled to another DC power (+5V) circuit trace 70.

One via 24 is shown which helps to form the can 26 (FIG. 6). Via 24 is essentially a conductive column of material that extends through each of layers 12*a*–12*o*. Finally, one of the RF vias 18 is illustrated. Via 18 extends through each of layers 12*a*–12*o* and includes a perpendicularly extending leg 74 formed on an outer surface of layer 12*a*.

Again, however, it will be appreciated that the drawing of FIG. 5 represents only a very small cross sectional portion of the probe-integrated printed wiring board 12. In practice, a large plurality of RF probe vias 18, and a large plurality of vias 24 for forming the can 26, will be implemented. For the phased array antenna system 10 shown in FIG. 2, 128 RF probe vias 18 are formed in the probe-integrated printed wiring board 12, together with a much larger plurality of vias 24. Also, it will be appreciated that the various electronic components used with the antenna system 10, although not shown, will be secured adjacent layer 12P in FIG. 5.

Figure 7:
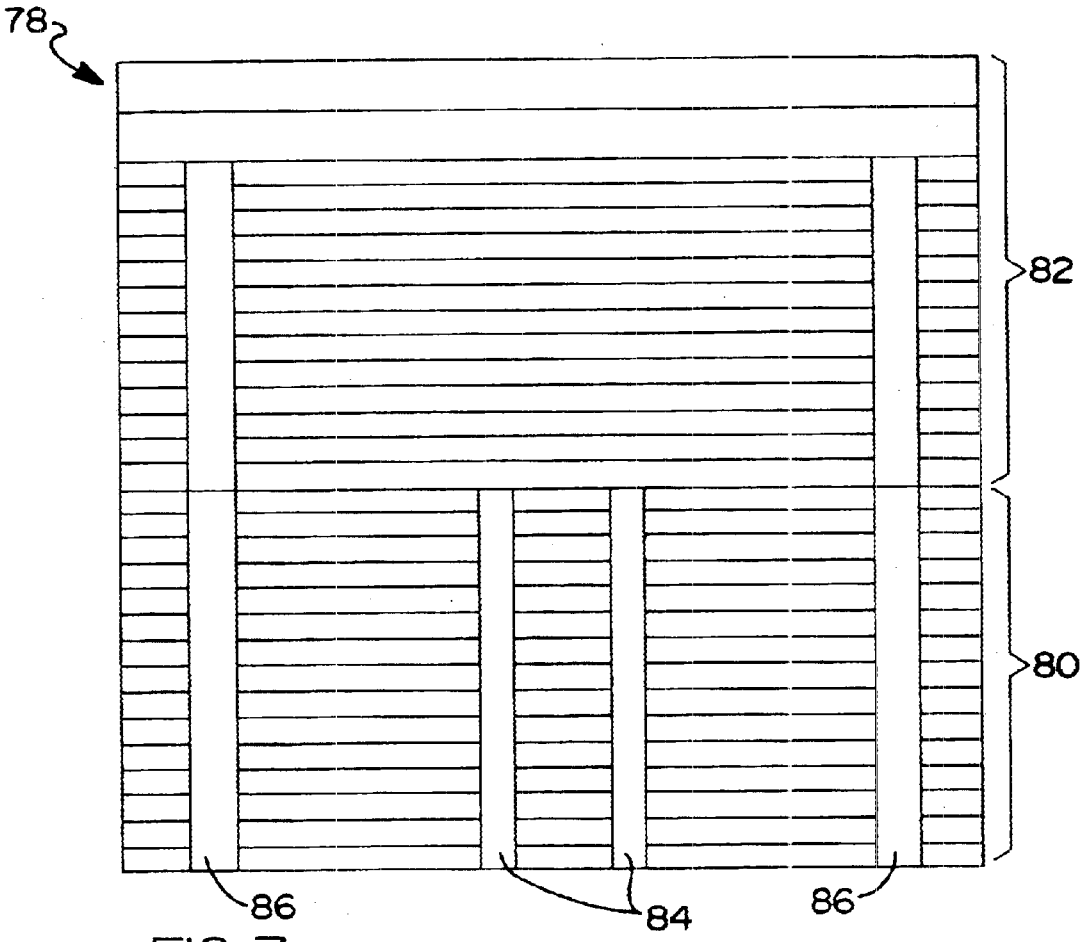
FIG. 7 is a view of an alternative preferred embodiment of the present invention wherein the probe-integrated printed wiring board and the waveguide printed wiring board are formed as a single, integrated, multi-layer printed wiring board.

It will also be appreciated that the probe-integrated printed wiring board 12 and the waveguide printed wiring board 14 could just as easily be formed as one integrally formed, multi-layer printed wiring board to form an antenna system 10 in accordance with an alternative preferred embodiment of the present invention. Such an implementation is illustrated in the cross sectional drawing of FIG. 7, wherein reference numeral 78 denotes the single multi-layer printed wiring board which includes a probe-integrated printed wiring board portion 80 and a waveguide printed wiring board portion 82. RF vias 84 extend through both boards 80 and 82 together with a plurality of vias 86 forming the can.

The preferred embodiments disclosed herein thus provide a means for forming a phased array antenna from a significantly fewer number of component parts, and in a manner which significantly eases the assembly of a phased array antenna system. The preferred embodiments are capable of being formed from an inexpensive, photolithographic process to create a single part, or two parts, which perform the functions of the WAIM, honeycomb structure, dielectric pucks, antenna probes, DC logic current and RF distribution circuit of a phased array antenna.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A phased array antenna system, comprising:

a multilayer printed wiring board including:

a via forming at least one antenna element;

a first plurality of layers for providing DC power, logic signals and RF power distribution;

at least one layer forming a waveguide structure disposed adjacent said first plurality of layers, and including a plurality of vias extending adjacent a portion of said antenna element to form a can at least substantially circumscribing said antenna element;

an uppermost layer forming a impedance matching layer for covering said layer forming said at least one waveguide structure; and an additional plurality of vias formed through selected ones of said layers for electrically communicating said DC power, said logic signals and said RF power distribution within said multilayer printed wiring board.

2. The antenna system of claim 1, wherein said multilayer printed wiring board comprises at least one trace for providing a positive DC voltage from a DC voltage source to said antenna system.

3. The antenna system claim 1, wherein said multilayer printed wiring board comprises a trace for providing a negative DC voltage from a negative DC voltage source to said antenna system.

4. The antenna system of claim 1, wherein said multilayer printed wiring board comprises a separate layer for providing a clock signal to said antenna system.

5. The antenna system of claim 1, wherein said multilayer printed wiring board comprises a separate layer for providing data to said antenna system.

6. The antenna system of claim 1, wherein said layer comprising said waveguide structure comprises a plurality of sub-layers sandwiched together, and wherein a plurality of vias are arranged in a circular pattern to extend through said sub-layers to form said can.

7. A phased array antenna system, comprising:

a multilayer printed wiring board including:

a probe-integrated, multi-layer wiring board assembly having a first plurality of layers and including circuits for providing DC power, logic signals and RF signal distribution functions, and for providing a plurality of RF radiating elements on one of said first plurality of layers thereof; and a waveguide, multi-layer wiring board assembly disposed adjacent said probe-integrated, multi-layer wiring board assembly, said waveguide, multi-layer wiring board assembly including:

a second plurality of layers having a plurality of vias extending therethrough to form a plurality of cans;

said cans functioning as waveguides and being aligned over said RF radiating elements, at least one of said second plurality of layers forming an impedance matching layer;

wherein said RF radiating elements are arranged in pairs, with each said can being aligned over a single respective pair of said RF radiating elements.

8. A method for manufacturing a phased array antenna system comprising:

using a sub-plurality of layers of a multi-layer printed wiring board to provide DC power signals and RF signal distribution functions;

using a plurality of RF vias to form a plurality of RF radiating elements extending through a plurality of layers of said multi-layer printed wiring board; and using a plurality of vias formed to extend through a selected sub-plurality of said layers of said multi-layer printed wiring board to circumscribe each of said RF vias, to thereby form a plurality of cans, each said can circumscribing a respective pair of said RF vias to form a waveguide structure.

9. The method of claim 8, wherein said antenna system is formed from a photolithographic process.

10. The method of claim 8, further forming an impedance matching layer on one outer surface of said sub-layers of said multi-layer printed wiring board.

11. A method for forming a phased array antenna system comprising:

using a plurality of layers of a multi-layer printed wiring board to provide DC power signals, logic signals and RF signal distribution functions;

using a plurality of RF vias to form a plurality of RF radiating elements extending through a plurality of layers of said multi-layer printed wiring board;

using a plurality of vias formed to extend through a selected subplurality of layers of said multi-layer printed wiring board to circumscribe each of said RF vias, to thereby form a plurality of cans, each said can circumscribing a selected pair of said RF vias to form a waveguide structure for its associated said selected pair of RF vias; and using at least one layer of said multi-layer printed wiring board to form an impedance matching layer.

12. A phased array antenna system, comprising:

a multilayer printed wiring board including:

a probe-integrated, multi-layer wiring board assembly having a first plurality of layers and including circuits for providing DC power, logic signals and RF signal distribution functions, and for providing a plurality of RF radiating elements on one of said first plurality of layers thereof; and a waveguide, multi-layer wiring board assembly disposed adjacent said probe-integrated, multi-layer wiring board assembly, said waveguide, multi-layer wiring board assembly including:

a second plurality of layers having a plurality of vias extending therethrough to form a plurality of cans;

said cans functioning as waveguides and being aligned over said RF radiating elements, at least one of said second plurality of layers forming an impedance matching layer; and wherein said probe-integrated multi-layer wiring board assembly and said waveguide multi-layer wiring board assembly are formed as a single piece printed wiring board assembly.

* * * * *